US006612870B1

(12) United States Patent
Rauscent

(10) Patent No.: US 6,612,870 B1
(45) Date of Patent: Sep. 2, 2003

(54) CONNECTOR OF THE INPUT/OUTPUT TYPE WITH GROUNDED SHIELDED CABLES AND METHOD OF PRODUCING AND OF MOUNTING SUCH A CONNECTOR

(75) Inventor: Eric Rauscent, Lormont (FR)

(73) Assignee: Thales Avionics S.A., Velizy Villacoublay (FR)

( * ) Notice: Subject to any disclaimer, the term of this patent is extended or adjusted under 35 U.S.C. 154(b) by 0 days.

(21) Appl. No.: 09/926,383

(22) PCT Filed: Apr. 26, 2000

(86) PCT No.: PCT/FR00/01096

§ 371 (c)(1),
(2), (4) Date: Oct. 23, 2001

(87) PCT Pub. No.: WO00/65695

PCT Pub. Date: Nov. 2, 2000

(30) Foreign Application Priority Data

Apr. 27, 1999 (FR) ..... 99 05324

(51) Int. Cl.[7] ..... H01R 9/03
(52) U.S. Cl. ..... 439/610; 439/938; 439/579
(58) Field of Search ..... 439/95, 98, 99, 439/101, 579, 607, 610, 939, 573, 589

(56) References Cited

U.S. PATENT DOCUMENTS 3,566,334 A 2/1971 Ziegler, Jr. ..... 439/248
3,594,687 A 7/1971 Alderfer ..... 439/581
3,852,700 A * 12/1974 Haws ..... 439/98
5,417,587 A 5/1995 Katsuda et al. ..... 439/559
5,709,569 A * 1/1998 Buck et al. ..... 439/607
5,733,146 A * 3/1998 Block ..... 439/610

FOREIGN PATENT DOCUMENTS

FR 2 673 149 8/1992

* cited by examiner

*Primary Examiner*—Lynn Feild
*Assistant Examiner*—Son V. Nguyen
(74) *Attorney, Agent, or Firm*—Oblon, Spivak, McClelland, Maier & Neustadt, P.C.

(57) ABSTRACT

A connector fitted with input and/or output cables of the coaxial or similar type, configured to be secured to the wall of an electrical apparatus. The connector includes a metal reinforcement having tabs that are inserted and gripped, at their ends, between a fastening plate attached to the connector and the wall of the electrical apparatus. The rear wall of the reinforcement has openings allowing the cables to pass through them. The cables have a stripped region soldered to the rear part of the reinforcement at the openings, to establish ground continuity between the shields of the cables and the wall of the electrical apparatus supporting the connector. A method produces and fits such a connector.

12 Claims, 3 Drawing Sheets

Figure 1:
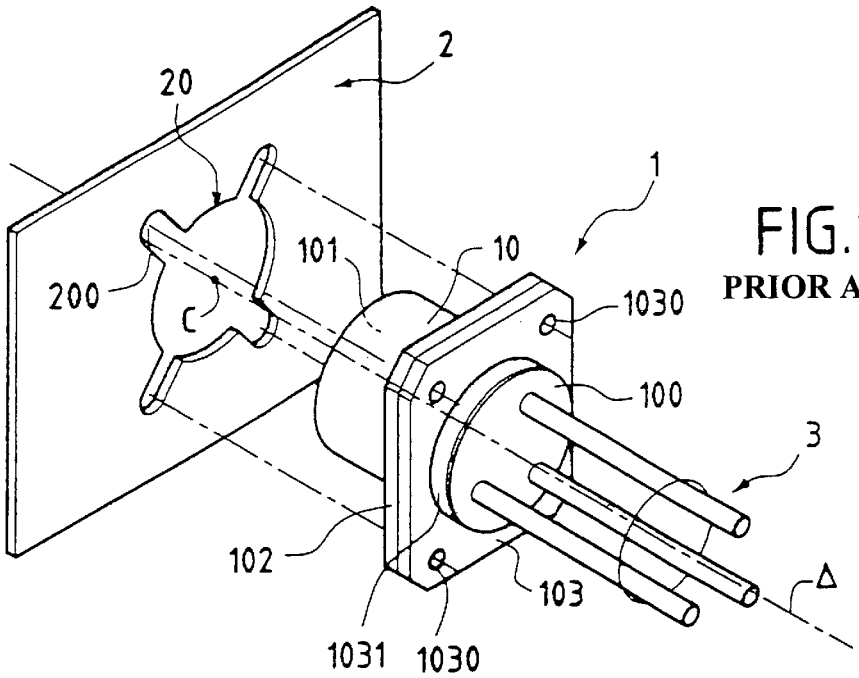
FIG.1 PRIOR ART

CONNECTOR OF THE INPUT/OUTPUT TYPE WITH GROUNDED SHIELDED CABLES AND METHOD OF PRODUCING AND OF MOUNTING SUCH A CONNECTOR

BACKGROUND OF THE INVENTION

1. Field of the Invention

The invention relates to a connector of the input/output type with grounded shielded cables, and more particularly to a connector whose inputs/outputs are cables of the coaxial type or of the type called "twinax", or similar cables.

The invention also relates to a method of producing such a connector.

2. Discussion of Background

The structure of a conventional coaxial cable comprises a central conductor, called the core, consisting of a solid wire, generally made of copper. The central core is surrounded by an electrically insulating dielectric which separates the core from an external cylindrical screen, generally a metal braid, forming a second conductor of a pair. The assembly is surrounded by a protective sheath made of electrically insulating material. More complex structures exist, comprising several central conductors and at least one metal screen, for example the structure called "twinax" structure comprising two solid central conductors. In the following, in order to be more concrete, the example of coaxial cables will be considered, without thereby limiting the scope of the invention.

One of the standard applications of such cables is the transmission of high-frequency AC or pulsed signals. Thus, coaxial cables or the like are associated with a number of critical electrical characteristics namely, in particular, the characteristic impedance, the operating frequency range, the attenuation, the reflection coefficient or standing wave ratio (SWR), etc. Furthermore, it is often necessary to connect the coaxial cable shields to the mechanical ground of the electrical and/or electronic items of equipment or apparatus in which they are used, so that the signals are defined with respect to a well-defined potential.

In many items of equipment, either because they are mobile or because they must themselves communicate with mobile, or at the very least disconnectable, apparatus, penetration connectors, of the complementary, male and female, type, are provided. Each pair of connectors establishes a connection of the coaxial type (or multi-coaxial type if there are several output cables per connector). Advantage is then taken of the presence of these connectors to fulfill the "grounding" function of the coaxial cables which pass through them.

This is because certain connectors, called "equipment" connectors, are provided with members which connect the outer metal shield of the coaxial contacts of various sizes to the metal body of the connector itself. In the term of the art, connectors of this type, which make it possible to fulfill the aforementioned grounding function, are often called "grounding" connectors. The ground continuity provided by them, between the item of equipment and the shield (braid) of the cable, must in general be less than 10 mΩ.

Although connectors of the aforementioned type allow both functions (signal transmission and grounding) to be fulfilled, they are not thereby without drawbacks. From the standpoint of use on an industrial scale, they have in particular the following major drawbacks:

- they have a high cost, typically about 2 to 3 kF, which cost must be compared with connectors of the same family (that is to say connectors having equivalent functions, apart from grounding), i.e. typically about 0.5 kF (namely in a ratio of about 1 to 5);
- in many cases, there is only a single source of supply (a single manufacturer and/or distributor), something which is not generally acceptable as there is then a serious risk of running out of stock;
- correspondingly, the continuity of supply is low, when it relies on the existence of a single source of supply;
- supply lead times are generally long, typically around 6 to 8 months; and
- connectors fulfilling the two aforementioned functions are not found in many families of "equipment"-type connectors, thereby restricting the choice of models.

There is therefore a need for connectors having at least one output per coaxial cable or the like, fulfilling the function of connecting the outer metal shield of the cable or cables to the mechanical ground of the item of equipment supporting the connector, but not having the drawbacks of the devices of the prior art, some of which have just been mentioned.

SUMMARY OF THE INVENTION

To do this, the connectors according to the invention are provided with a specific member making it possible, in particular:

- to provide the aforementioned grounding function;
- to be able to fit with all standard connector families, whether of circular or rectangular overall shape;
- to take up a minimum amount of volume at the rear of the connector;
- to be easy to connect and disconnect;
- to incur only a small additional cost compared with a standard connector not providing the grounding function; and
- to provide ground continuity of less than 10 mΩ, as in the prior art.

The aforementioned member is based on a single and simple component consisting of a metal reinforcement, which will hereafter be called a "foil", comprising a part surrounding the connector and extensions placed between the connector and the mechanical structure of an item of equipment which supports this connector. More specifically, the foil is mounted so as to be gripped between the mechanical structure of the item of equipment, which supports a standard connector, and this connector. In general, the equipment has a plane wall provided with an opening intended to accommodate the body of the connector and means for fastening the latter. The front of the connector allows mechanical and electrical coupling to a connector of complementary type. The coaxial cable or cables emerge at the rear of the body of the connector, from and to other members internal to the item of equipment. The front part of the coaxial cables is provided with contacts, which are also coaxial, intended to house contacts of complementary type.

Even more specifically, the foil itself comprises a wall surrounding the rear of the connector and being extended toward the front by lateral flanges, preferably consisting of tabs, the tabs themselves having bent-over end parts gripped between the front of the body of the connector and the rear of the support wall of the item of equipment. The rear wall of the foil has one or more holes. Slipped into each hole is a coaxial cable or the like, forming one of the inputs/outputs of the connector. Each coaxial cable is stripped, as required, at these holes and is soldered to the foil.

It follows that the aforementioned member or "foil" properly meets the objectives that the invention has set itself:

- it fulfills the grounding function, with a typical galvanic continuity of less than or equal to 2.5 mΩ;
- the additional volume at the rear of the connector, owing to the arrangements of the invention, is very small;
- such a member is easy to connect and/or disconnect, as will be shown in further detail; and
- the additional cost owing to the invention is low, whether in terms of additional material needed or in terms of additional cost during the manufacturing process (the manufacturing steps specific to the invention not being very complex).

The subject of the invention is therefore a connector of the type comprising a main body of defined shape, fastening means and at least one input and/or output with a cable having at least one external shield and leaving via one face, called the rear face, of the connector, said connector being intended to be mounted in a wall made of electrically conducting material of an item of electrical and/or electronic equipment and secured to this wall by said fastening means, characterized in that each of said external shields of the cables is made accessible from the outside in a defined region of the end of said cable close to said rear face, in that it includes a reinforcement made of electrically conducting material having at least one rear wall provided with as many holes as there are cables, so that it can be slipped over the cables, and lateral flanges having end parts bent over the cables inward and intended to be inserted and gripped between said fastening means and said wall made of electrically conducting material, when the connector is secured to this wall, and in that said regions of said shield which are accessible from the outside are electrically coupled to said rear wall of the reinforcement at said holes, so as to establish electrical continuity between said wall made of electrically conducting material and said shield when the connector is secured to this wall.

The subject of the invention is also a method of producing such a connector.

BRIEF DESCRIPTION OF THE DRAWING FIGURES

Figure 2A:
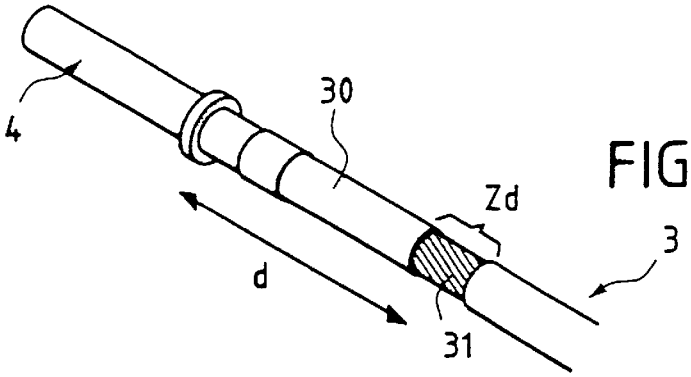
Figure 2B:
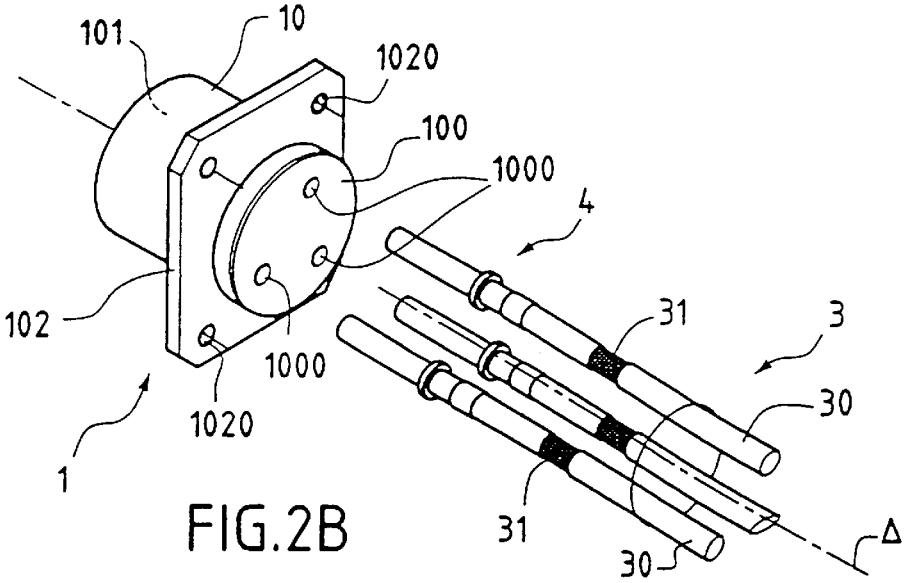
Figure 2C:
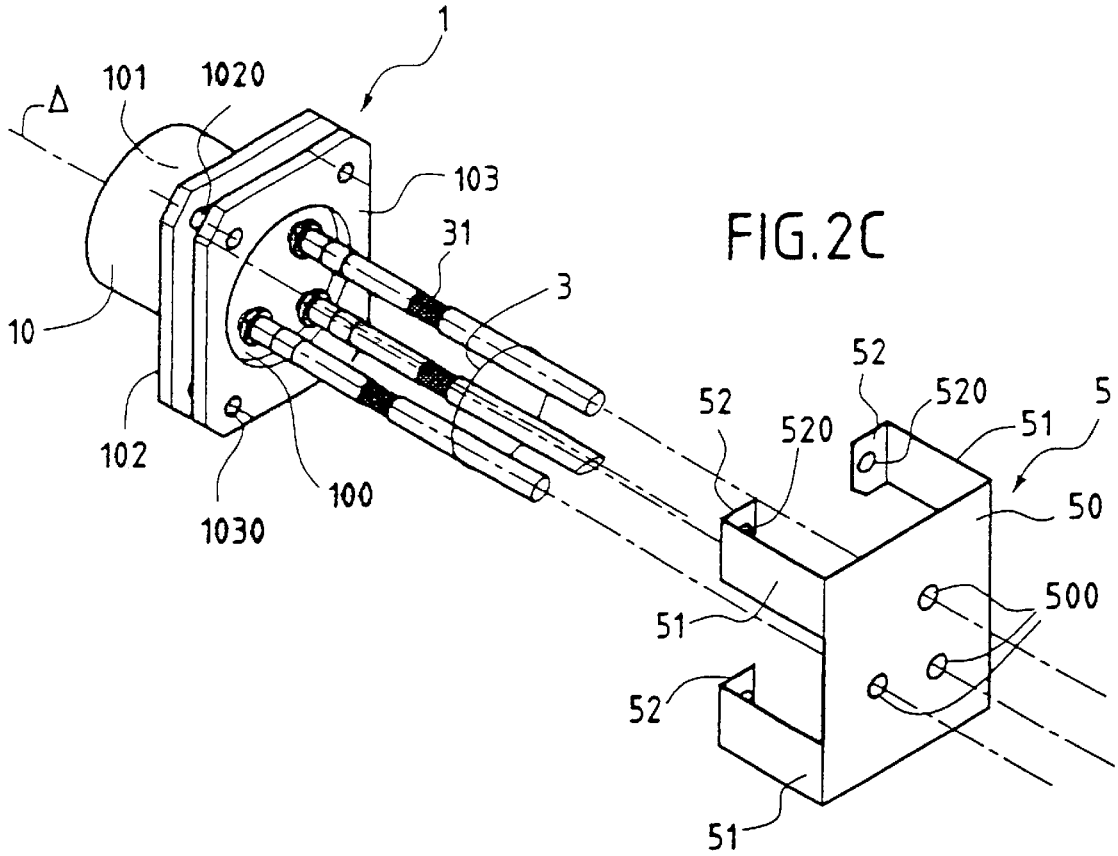
Figure 2D:
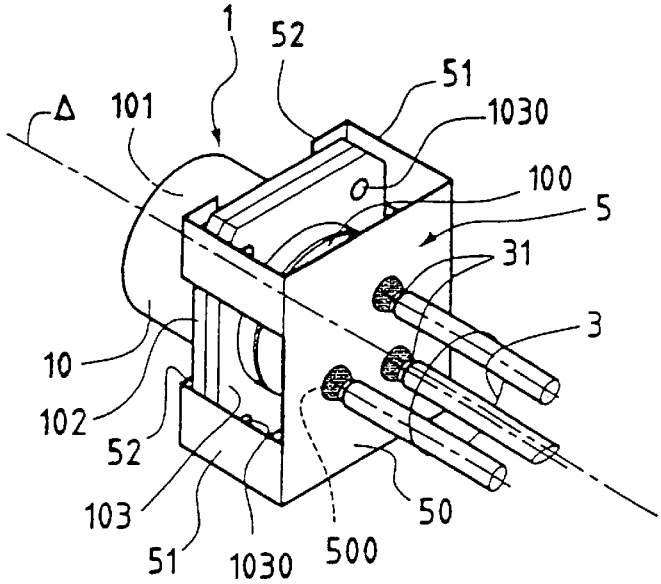
Figure 2E:
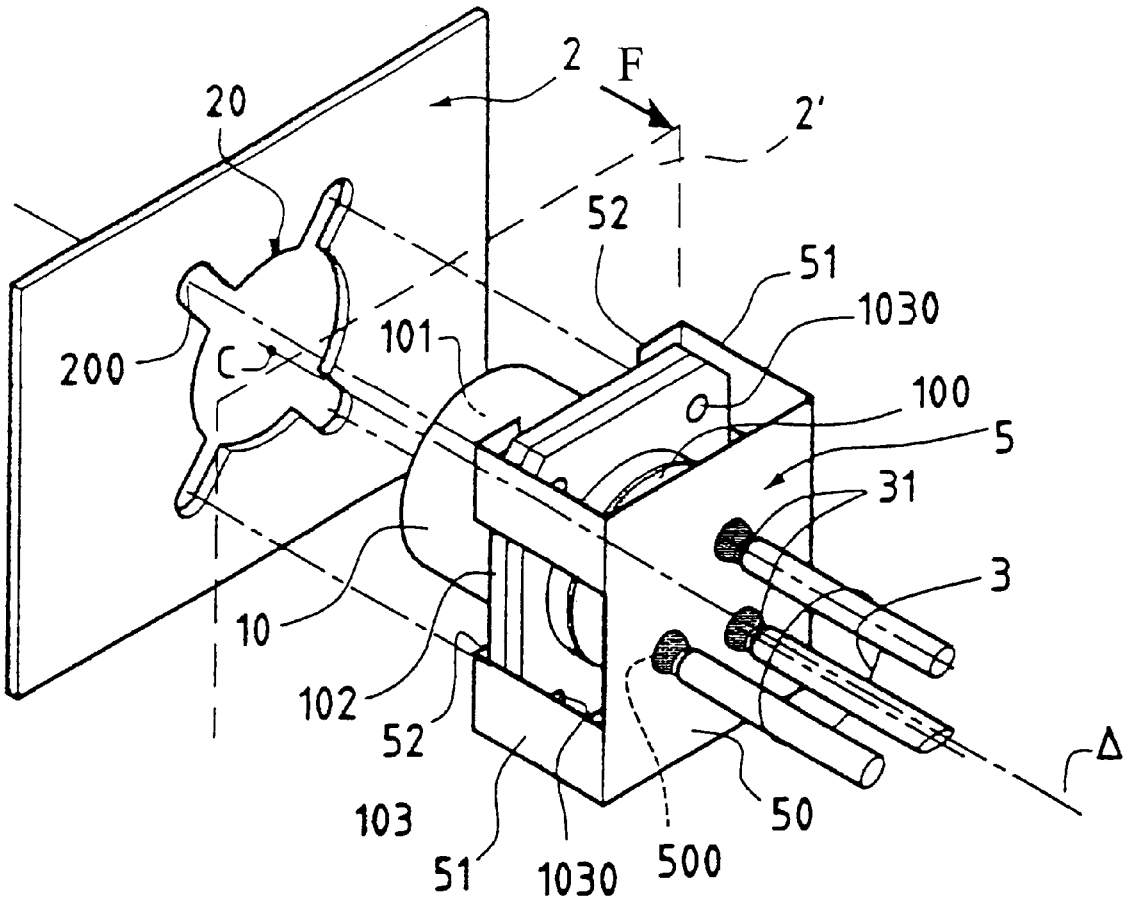

The invention will now be described in greater detail with reference to the appended drawings, in which:

FIG. 1 illustrates schematically, in exploded view, an example of a standard connector with coaxial contacts, of circular cross section, intended to be mounted in a wall of an item of equipment; and FIGS. 2A and 2E illustrate the main steps in the production of a connector according to the invention.

DETAILED DESCRIPTION OF THE PREFERRED EMBODIMENTS

In the following, in order to be more concrete, without thereby limiting the scope of the invention, the specific case of a connector of circular cross section, fitted with coaxial contacts and input/output cables which are also coaxial, will be considered.

FIG. 1 illustrates, in exploded view, an example of a structure of a standard connector 1, the body 10 of which is of approximately cylindrical shape, being fastened to a wall 2 of an item of equipment (not shown), only a fraction of which has been shown.

To give a concrete example, it has been assumed that the connector 1 is fitted with three coaxial contacts (not visible) emerging in the front face 101. These contacts are extended, in the rear face 100, by three coaxial cables 3, carrying signals, from and/or to other members (not shown) placed inside the item of equipment supporting the connector 1.

Within the context of the invention, the term "standard" denotes here a connector 1 which does not fulfill the function of grounding between the shielding screen (not visible in FIG. 1) of the coaxial cables 3 and the support wall 2 of the item of equipment.

To fasten the connector to the wall 2, a hole 20, of shape and size such that the body 10 of the connector 1 may be introduced thereinto, is provided. In the present case, the hole 20 is of circular shape and has a diameter slightly greater than that of the body 10. The body 10 of the connector 1 is furthermore provided with a peripheral fastening plate 102 which is secured thereto or with a similar member, for example of substantially square or rectangular shape. This plate 102 lies in a plane orthogonal to the axis of symmetry Δ of the body 10 and is made integral with the latter, for example by soldering during manufacture. A removable backplate 103, having a circular central hole 1031 in order to be able to be slipped over the body 10, is also often provided. The plates 102 and 103 also have fastening holes (only those of which, 1030, in the plate 103 are visible in FIG. 1), for example placed at the four corners.

The wall 2 also has holes or cut-outs 200 intended for fastening the connector 1, these being made around the periphery of the main hole 20. These holes or cut-outs 200 are placed in a space, one with respect to the other around the center of symmetry C of the hole 20, so as to be in registration with the holes, for example 1030, in the plates 102 and 103.

The connector 1 is finally joined to the wall 2 by inserting its body 10 into the hole 20 up to the point where the plate 102 bears on the wall 2. All that is then required is to bring the holes in this plate 102 and the holes 210 in the wall 2, together with those, 1030, in the plate 103, into registration and to use conventional members of the screw-nut type (not shown) in order to lock the connector 1 to the wall 2. The backplate 103 may be placed against the plate 102, as illustrated in FIG. 1, or, in an embodiment not shown, slipped over the body 10, on the other side of the wall 2 (by convention, the front face), before being clamped by the screw-nut members. The wall 2 is then gripped between the plates 102 and 103.

Mechanical grounding of the shields of the rear coaxial cables 3, that is to say coupling between these shields and the wall 2, assumed to be made of metal, is not intrinsically provided by a standard-type connector. If this function has to be provided, it is then necessary to use a grounding connector, as mentioned, which intrinsically allows this grounding to be accomplished. However, as also mentioned, this type of connector has many drawbacks.

An embodiment of a connector according to the invention, and its main production steps, will now be described with reference to FIGS. 2A to 2E. It should be clearly understood that certain production steps are common with the prior art. The specific steps will be explained in detail.

The elements common to the previous figures bear the same reference numbers and will be described again only when necessary.

FIG. 2A illustrates in greater detail an example of a coaxial cable 3 fitted at its end with a coaxial contact 4 intended to be inserted into the body 10 of the connector 1, as shown in FIG. 2B. The coaxial cable 3, as mentioned, usually comprises an outer protective sheath 30, made of electrically insulating material. This sheath 30 covers the shield 31, generally consisting of a tightly-meshed metal braid.

According to a first characteristic of the invention, the cable 3 is stripped in a region Zd at a predetermined distance d from the end of the coaxial contact 4. This operation constitutes a first step in mounting a connector 1 according to the invention.

FIG. 2B illustrates a standard connector 1, of the type shown in FIG. 1. However, on the one hand, the coaxial contacts 4 have not yet been inserted into the body 10 of the connector 1 via its rear face 100 and, on the other hand, according to one of the characteristics specific to the invention, the cables 3 have a stripped region Zd.

In a subsequent step, the contacts 4 are inserted into longitudinal channels 1000 (parallel to the axis Δ) which are provided for this purpose and emerge on the rear face 100 of the body 10 of the connector 1. These channels 1000, parallel to the axis Δ, pass right through the body 10 so as to also emerge on the front face 101. Quite conventionally, the length of the contacts 4 is generally less than the length of the body 10 of the connector 1. Consequently, part of the end of the cables 3 bearing the contacts 4 is also inserted into the channels 1000.

The contacts 4 are shown fully inserted in FIG. 2C. The backplate 103 may also be slipped over the body 10. These insertion operations are common, per se, to similar operations necessary for producing a connector according to the prior art (FIG. 1).

FIG. 2C also shows an essential element of a connector 1 according to the invention. To fulfill the "grounding" function between the braid 31 and the mechanical structure 2 (FIG. 1) of an item of equipment or apparatus, according to a second very important characteristic of the invention, a metal reinforcement 5, called a "foil", having an approximately plane rear wall 50, is used. This rear face 50 is provided with holes 500 having the same spatial configuration as the holes 1000 (FIG. 2B) so that the rear wall 50 can be slipped over the cables. Furthermore, the distance d is such that the stripped region Zd lies outside the body 10 of the connector 1, but in the immediate vicinity of the rear face 100, when the foil is slipped over the cables 3 as shown in FIGS. 2D and 2E. The holes 500 advantageously have a circular cross section, of diameter slightly greater than the external diameter of the sheath 30.

According to another characteristic, the foils 5 are provided with flaps 51 bent rearward by approximately 90 degrees with respect to the wall 50 and having, at their ends, a second bent-over part 52, bent inward again through 90 degrees. Advantageously, the flaps form narrow tabs, for example four tabs at the top and bottom edges of the rear wall 50 on both sides of the latter. The length of the tabs is such that the bent-over end parts 52 hold the fixed plate 102 captive and pass in front of this plate when the foil is fitted (see FIGS. 2D and 2E). FIG. 2C illustrates the foil 5 before it is fitted, that is to say before it is slipped over the coaxial cables 3. This figure also shows the fastening holes 1020 in the plate 102.

FIG. 2D illustrates the "connector 1/foil 5" assembly mounted.

The final operation, before fitting the connector 1 and its foil 5 into the structure 2, consists in soldering the shields (the braids 31) to the rear face 50 of the foil. This step, also specific to the invention, makes it possible to ensure that there is good electrical continuity between the shields 31 and the foil 5. This operation may be carried out in a known manner, for example by soldering with the aid of an induction iron.

As illustrated more particularly in FIG. 2E, the body 10 of the connector 1 is inserted into the opening 20. The wall 2 is then made to bear against the front face of the fastening plate 102 (position 2': arrow F). However, it should be clearly understood that this is a relative movement. In fact, it is the connector 1 which is subjected to a translational movement.

The final operation, also common, per se, to the prior art, consists in securing the "connector 1/foil 5" assembly to the wall 2. As in the case of FIG. 1, any suitable conventional means, for example members of the screw-nut type, are used.

The bent-over ends 52 of the tabs 51 are then gripped between the rear of this wall 2 and the front wall 101 of the body 10. This gripping ensures that there is good electrical continuity between the wall 2, and therefore the item of equipment of which it forms part, and the foil 5. Consequently, since the latter is soldered to the shields 31, in the stripping region Zd, high-quality mechanical grounding between the structure (represented by the wall 2) and the shields 31 of the coaxial cables 3, is achieved in a simple manner.

In order to ensure that electrical continuity remains over time, it is necessary for the surface of the foil not to oxidize. Thus, it is advantageous to carry out an initial surface treatment.

To be more specific, a practical embodiment of the foil 5 will now be presented:

- constituent material of the foil 5: beryllium copper (for example, known by the brand name "UBE 2");
- surface treatment: chemical nickel plating and local tinning by dipping in a material of brand name "SN15/CU10", in order to solder the rear face 50 to the shields 31;
- typical thickness: 0.2 mm;
- diameter of the holes 500=diameter of the cables 3 (sheath 30)+1 mm;
- gripping area (end tabs 52), distributed between the fastening points: a minimum of 200 $mm^2$; and
- distance between the rear face 100 of the body 10 of the connector 1 and the soldering face 50 of the foil: a minimum of 5 mm.

As indicated, the invention relates to connectors of various shapes: circular cross section, rectangular cross section, etc. It goes without saying, under these conditions, that the exact shape of the foil 5 and its dimensions also depend on the configuration of the connector in question. This aspect is still within the scope of a person skilled in the art, without there being a need to expand on this any further.

Having read the foregoing, it may be easily seen that the invention clearly achieves the objectives that it has set itself.

Comparing costs, a standard connector typically costs 300 F and a special connector of the "grounding" type costs 2 000 F, but the additional cost for the foil alone is approximately 200 F. It follows that a connector according to the invention, fitted with its foil, typically costs 500 F, i.e. four times less than a so-called "grounding" connector having equivalent characteristics.

The materials that can be used to produce the foil are everyday materials. Many configurations of standard connectors and many sources of supply are commercially available. A connector according to the invention, based on a standard connector and the metal reinforcement called the foil, therefore does not have the dangers inherent in a connector from a single or almost single source: continuity of supply not guaranteed, risk of running out of stock, etc.

The additional volume of the connector according to the invention compared with a standard connector is very small: additional thickness of about 5 mm on the rear face, plus the thickness of the material on the front face (the bent-over parts of the tabs being placed between the front face of the connector and the rear face of the wall of the item of equipment), i.e. 2 mm in the example described.

Finally, implementation is simple. There is no need for specific tooling in order to produce and mount such a connector.

However, it must be clearly understood that the invention is not limited merely to the embodiments explicitly described, especially in relation to FIGS. 2A to 2E. It should especially be pointed out that, although the invention has been described more particularly in the case of connectors of circular cross section, this description in no way limits the scope of the invention.

Furthermore, the numerical values, for example the geometrical dimensions, were only specified in order to give concrete examples. They essentially depend on the precise application envisioned.

Finally, there are many materials that can be used to produce the grounding reinforcement, called the "foil", and a person skilled in the art is competent to make a simple technological choice thereof.

What is claimed is:

1. A connector comprising:

a main body of defined shape;

fastening means partly attached to the main body; and at least one cable having at least one external shield and extending from a rear face of the main body of the connector, the connector configured to be mounted in an electronic equipment wall made of electrically conductive material and secured to the electronic equipment wall by the fastening means, wherein the at least one external shield of the at least one cable is made accessible from an outside of the connector; and a reinforcement made of electrically conductive material having at least one reinforcement wall provided with at least one aperture, so that the reinforcement can be slipped over the at least one cable, the reinforcement including lateral flanges each having an end part bent over inwardly and configured to be inserted and gripped between the fastening means and the electronic equipment wall when the connector is secured to the electronic equipment wall, and wherein the at least one external shield of the at least one cable is electrically coupled to the at least one reinforcement wall of the reinforcement at an outer circumference of the at least one aperture, so as to establish electrical continuity between the electronic equipment wall and the at least one external shield of the at least one cable when the connector is secured to the electronic equipment wall.

2. The connector as claimed in claim 1, wherein the at least one reinforcement wall of the reinforcement is substantially planar and of rectangular shape, the lateral flanges being bent at a 90 degree angle with respect to the at least one reinforcement wall of the reinforcement and the end part of each of the lateral flanges being bent at a 90 degree angle, so that, when the reinforcement is slipped over the at least one cable, the end part of each of the lateral flanges are placed between the fastening means and the electronic equipment wall when the connector is secured thereto.

3. The connector as claimed in claim 2, wherein:

the fastening means comprises at least one plate which is approximately rectangular;

the electronic equipment wall has a hole configured to allow the main body of the connector to be inserted thereinto so that the at least one plate of the fastening means bears against a face of the electronic equipment wall; and the end part of each of the lateral flanges are gripped between the at least one plate of the fastening means and the electronic equipment wall.

4. The connector as claimed in claim 3, wherein the fastening means further comprises fastening holes made in the at least one plate, and screw-nut members cooperating with the fastening holes to secure the at least one plate to the electronic equipment wall.

5. The connector as claimed in claim 1, wherein the at least one external shield of the at least one cable is covered with a protective sheath made of electrically insulating material.

6. The connector as claimed in claim 1, wherein the at least one reinforcement wall of the reinforcement is soldered to the at least one external shield of the at least one cable by a soldered joint.

7. The connector as claimed in claim 1, wherein the least one cable is a coaxial-type cable comprising a central core surrounded by a metal braid forming the at least one external shield.

8. The connector as claimed in claim 1, wherein a constituent material of the reinforcement is based on beryllium copper.

9. A method of producing and mounting a connector according to claim 1, the method comprising the steps of:

providing a first end the at least one cable with a contact element;

covering the at least one external shield of the at least one cable with a protective sheath made of electrically insulating material; and stripping a region of defined length at a predetermined distance from each of the contact elements;

providing the main body of the connector with at least one longitudinal channel passing through the main body;

inserting the contact element into the at least one longitudinal channel so that the at least one cable extends from the rear face of the main body of the connector;

slipping the at least one reinforcement wall of the reinforcement over the at least one cable passing through the at least one aperture in the at least one reinforcement wall;

positioning the end part of each of the lateral flanges in front of the fastening means of the connector; and soldering the at least one reinforcement wall to the region being stripped from the contact element so as to establish electrical continuity between the reinforcement and the at least one external shield of the at least one cable.

10. The method as claimed in claim 9, wherein the soldering of the at least one reinforcement wall includes soldering with an induction iron.

11. The method as claimed in claim 9, further comprising inserting the main body into a main body insertion hole in the electronic equipment wall and securing the main body of the connector to the electronic equipment wall through use of the fastening means, so as to grip the end part of each of the lateral flanges of the reinforcement between the fastening means of the connector and the electronic equipment wall.

12. The method as claimed in claim 9, further comprising a preliminary step of treating a surface of constituent material of the reinforcement, and wherein the treating of the surface of the constituent material includes chemical nickel plating and local tinning by dipping, to allow for the soldering of the at least one reinforcement wall to the region being stripped by the contact element.

* * * * *